US006974163B2

(12) United States Patent
Peng et al.

(10) Patent No.: US 6,974,163 B2
(45) Date of Patent: Dec. 13, 2005

(54) TUBULAR DOOR LOCK HAVING SELECTIVE ACTUATORS

(76) Inventors: Fu Chang Peng, P.O. Box 10-69, Chong Ho, Taipei (TW) 235; Alan Liang, P.O. Box 10-69, Chong Ho, Taipei (TW) 235; Chih Hung Hsiao, P.O. Box 10-69, Chong Ho, Taipei (TW) 235

( * ) Notice: Subject to any disclaimer, the term of this patent is extended or adjusted under 35 U.S.C. 154(b) by 59 days.

(21) Appl. No.: 10/677,879

(22) Filed: Sep. 30, 2003

(65) Prior Publication Data

US 2005/0067843 A1 Mar. 31, 2005

(51) Int. Cl.[7] ..... E05C 1/12; E05B 9/00
(52) U.S. Cl. ..... 292/1.5; 292/337; 292/DIG. 60
(58) Field of Search ..... 292/336.3, 337, 292/1.5, 169, DIG. 60

(56) References Cited

U.S. PATENT DOCUMENTS 4,834,432 A * 5/1989 Smallegan et al. ..... 292/337
4,927,199 A * 5/1990 Wu et al. ..... 292/1.5
5,169,184 A * 12/1992 Bishop ..... 292/1.5
RE34,240 E 5/1993 Lin ..... 292/337
5,257,838 A 11/1993 Lin ..... 292/1.5
5,354,109 A 10/1994 Lin ..... 292/1.5
5,490,695 A * 2/1996 Shiue ..... 292/1.5
5,551,736 A * 9/1996 Fann et al. ..... 292/1.5
5,613,715 A * 3/1997 Kim ..... 292/337
5,620,211 A * 4/1997 Ellis ..... 292/1.5
6,030,008 A * 2/2000 Chang ..... 292/1.5
6,186,562 B1 * 2/2001 Huang ..... 292/337
6,536,816 B1 * 3/2003 Fan ..... 292/1.5
6,688,660 B2 * 2/2004 Huang ..... 292/337

* cited by examiner

*Primary Examiner*—Daniel P. Stodola
*Assistant Examiner*—Christopher Boswell
(74) *Attorney, Agent, or Firm*—Charles E. Baxley

(57) ABSTRACT

A tubular door lock includes a dead bolt and a follower slidably received in a housing and coupled together. The follower included a groove formed between two levers, two actuators are rotatably received in the housing and each includes one or more actuating fingers engageable with the levers of the follower, for selectively actuating the levers of the follower to move the dead bolt relative to the housing, when the actuators are rotated relative to the housing. The provision of the actuators in different positions relative to the housing allows the lock device or the knob to engage with either of actuators, for allowing the lock device and the knob to be secured into the door panel at different positions.

3 Claims, 7 Drawing Sheets

TUBULAR DOOR LOCK HAVING SELECTIVE ACTUATORS

BACKGROUND OF THE INVENTION

1. Field of the Invention

The present invention relates to a tubular door lock, and more particularly to a tubular door lock having selective actuators for fitting to different door panels.

2. Description of the Prior Art

Typical tubular door locks comprise a pair of extensions extended from a cylindrical housing and coupled to dead bolts, and an actuator wheel rotatably attached to the cylindrical housing and having one or more actuator teeth for engaging with the extensions of the cylindrical housing, and actuating or moving the dead bolts into the cylindrical housing.

For example, U.S. Pat. No. Re. 34,240 to Lin, U.S. Pat. No. 5,257,838 to Lin, and U.S. Pat. No. 5,354,109 to Lin disclose three of the typical tubular door locks comprise an actuator wheel rotatably attached to a pair of plates of the cylindrical housing, and slidable or adjustable relative to the plates of the cylindrical housing, for allowing the typical tubular door locks to be attached to different positions of the door panels.

Normally, the plates of the cylindrical housing include two oblong holes formed therein, to slidably receive the actuator wheel, and one or more spring members are required to be attached to the plates, for retaining the actuator wheel in either of two positions in the plates.

However, the spring members may not solidly retain the actuator wheel to the plates, and may have a good chance to be moved relative to the plates in advertently.

The present invention has arisen to mitigate and/or obviate the afore-described disadvantages of the conventional tubular door locks.

SUMMARY OF THE INVENTION

The primary objective of the present invention is to provide a tubular door lock including selective actuators for fitting to different door panels.

In accordance with one aspect of the invention, there is provided a tubular door lock comprising a housing including a chamber and an opening formed therein and communicating with each other, a dead bolt slidably received in the chamber and the opening of the housing, and movable in and out of the opening of the housing, a follower slidably received in the chamber of the housing, and coupled to the dead bolt, for moving the dead bolt relative to the chamber and the opening of the housing, the follower including a groove formed therein, and defined between two levers, two actuators rotatably received in the housing, and each including at least one actuating finger extended therefrom, and engageable with the levers of the follower, for selectively actuating the levers of the follower to move the dead bolt relative to the housing, when the actuators are rotated relative to the housing. The provision of the actuators in different positions relative to the arm and the housing allows the lock device or the knob to engage with and to be secured to either of actuators, and thus for allowing the tubular door lock to be secured into the door panel and to be coupled to the lock device and the knob at different locations or positions.

Each of the levers of the follower includes a lower portion having a first seat provided thereon the thereof, and an upper portion having a second seat provided thereon, for selectively engaging with the actuating fingers of the actuators respectively. Each of the actuators includes an engaging hole formed therein for receiving rotating tools of The housing includes at least one arm extended therefrom and having an orifice and an aperture formed therein to rotatably receive the actuators respectively. A block may further be provided and includes an orifice and an aperture formed therein to rotatably receive the actuators respectively.

The arm of the housing includes a depression formed therein, and the block includes at least one bulge extended therefrom for engaging into the depression of the housing, and for anchoring the block to the housing. The block includes a cap provided thereon for engaging with the levers of the follower, and for anchoring the block to the housing.

The housing includes a stud extended therein and engaged into the groove of the follower, to guide the follower to move relative to the housing. The follower includes at least one shoulder formed therein, to engage with the housing, and to limit a movement between the follower and the housing.

The dead bolt includes a plate extended therefrom and having a passage formed therein, the follower includes a hook extended therefrom, and slidably engaged through the passage of the plate, and engageable with the plate, for moving the plate and the dead bolt relative to the housing when the follower is moved relative to the housing by either of the actuators.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
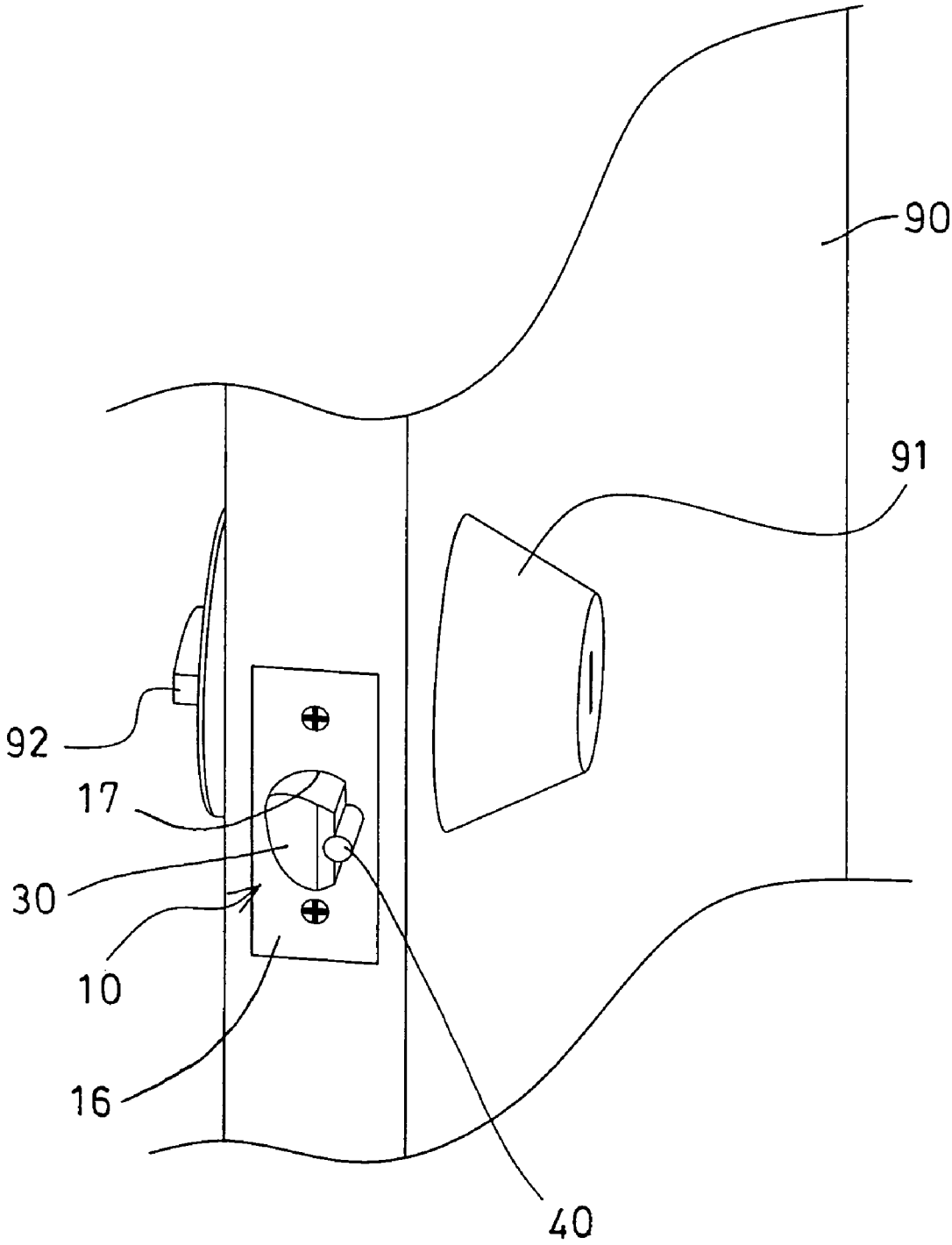
FIG. 1 is a partial perspective view illustrating an attachment of a tubular door lock in accordance with the present invention into a door panel.

Referring to the drawings, and initially to FIG. 1, a tubular door lock 10 in accordance with the present invention is provided for attaching into a door panel 90, and comprises a dead bolt 30 and a latch 40 to be actuated or operated with a lock device 91 and a knob 92. The dead bolt 30 includes a slot 31 formed therein (FIG. 4) to slidably receive the latch 40 therein.

As shown in FIGS. 2–5, the tubular door lock 10 includes a cylindrical housing 11 formed by such as two housing members 12, 13 that may be secured together with fasteners, latches (not shown), adhesive materials, or by welding processes, or the like, and one or more plates 15, 16 secured to the front portion of the housing 11 for attaching or securing to the door panel 90.

The above-described structure of the cylindrical housing 11 and the dead bolt 30 and the latch 40 and the lock device 91 and the knob 92 is typical and will not be described in further details. The tubular door lock 10 is provided for allowing the tubular door lock 10 to be actuated or operated with the lock device 91 and the knob 92 that may be attached to different positions relative to the housing 11 and the door panel 90.

Figure 4:
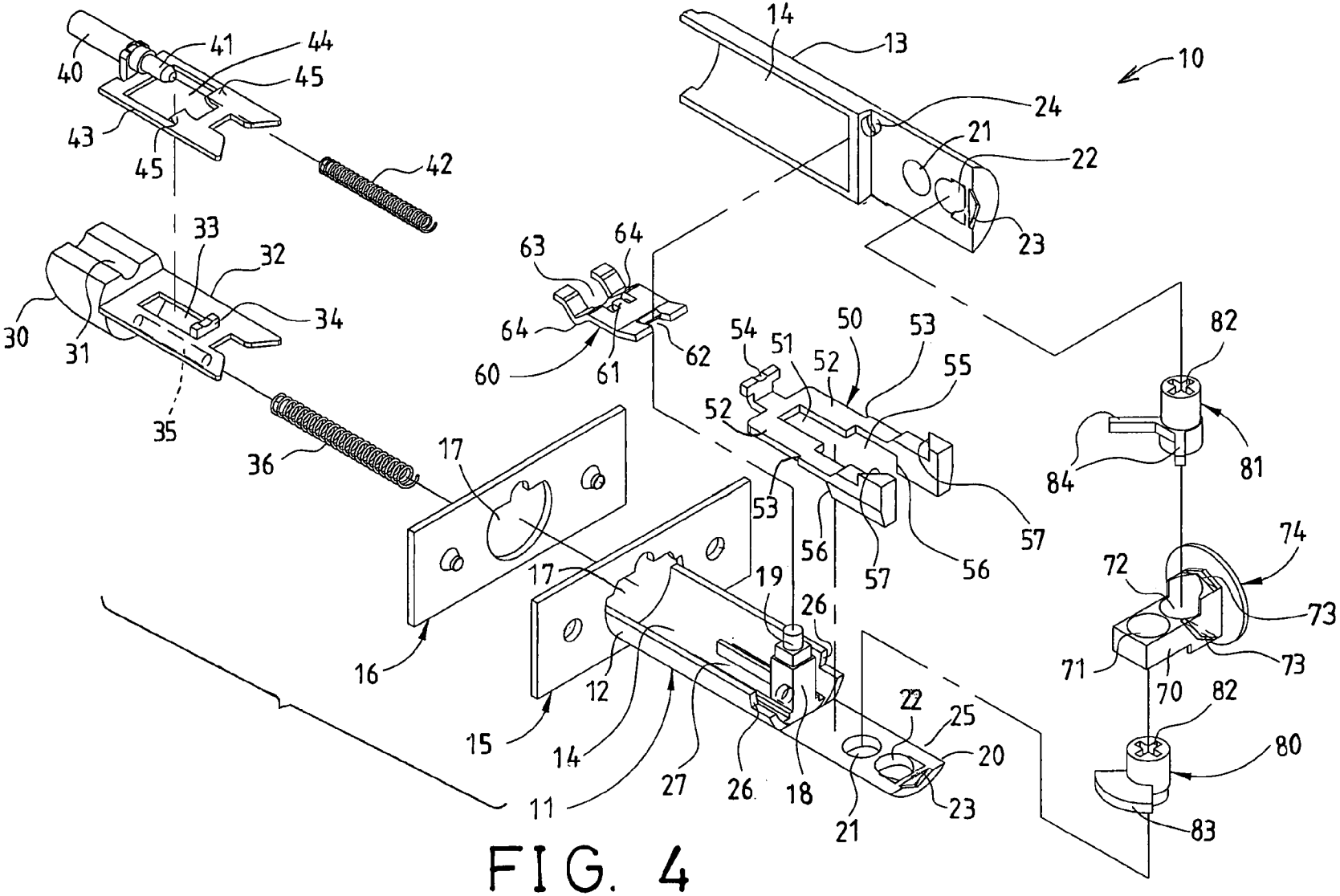
FIG. 4 is an exploded view of the tubular door lock.
Figure 5:
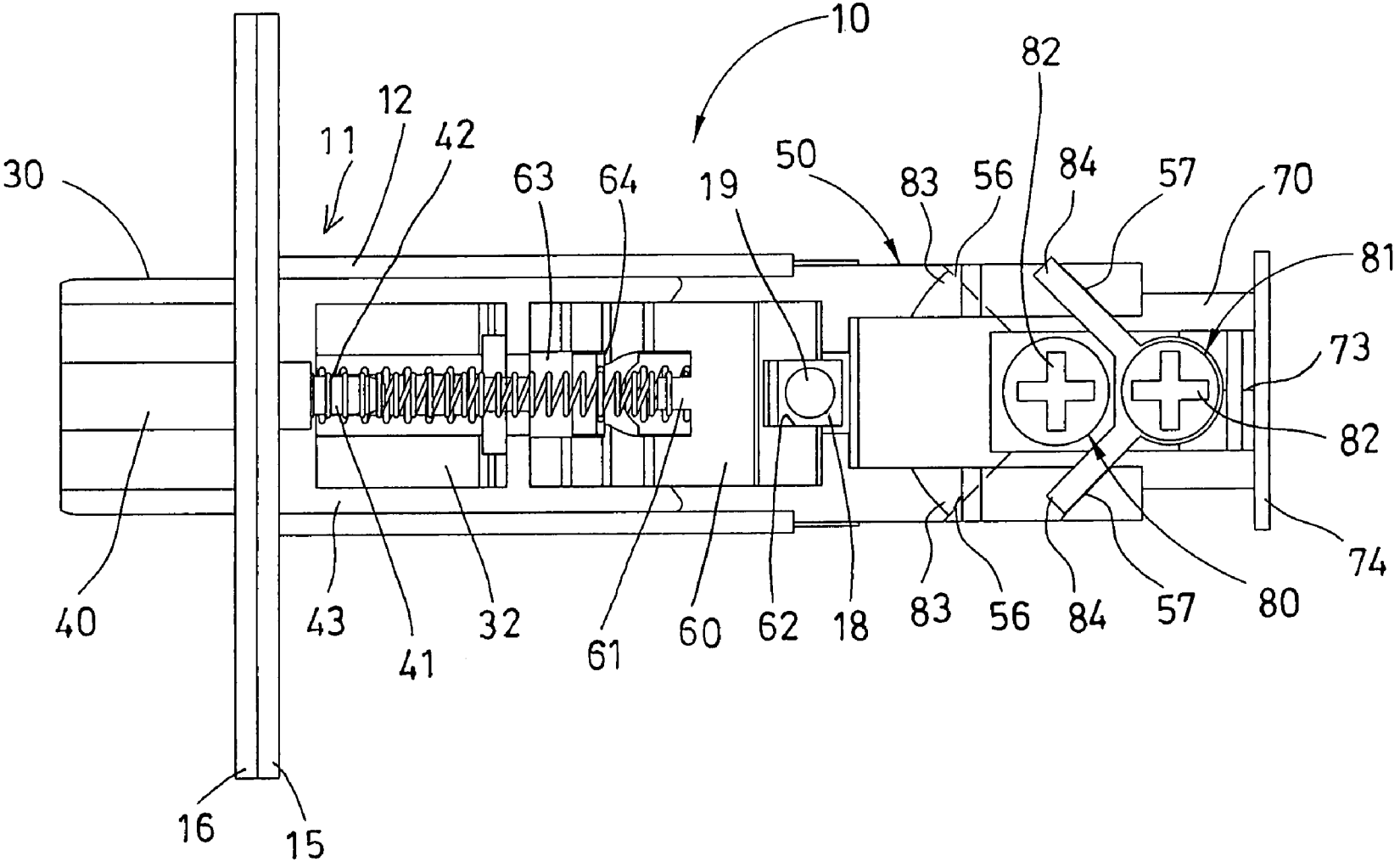
FIGS. 5, 6, 7 are top plan schematic views of the tubular door lock, in which a portion of the cylindrical housing has been removed from the cylindrical housing, to show the inner structure of the tubular door lock.
Figure 6:
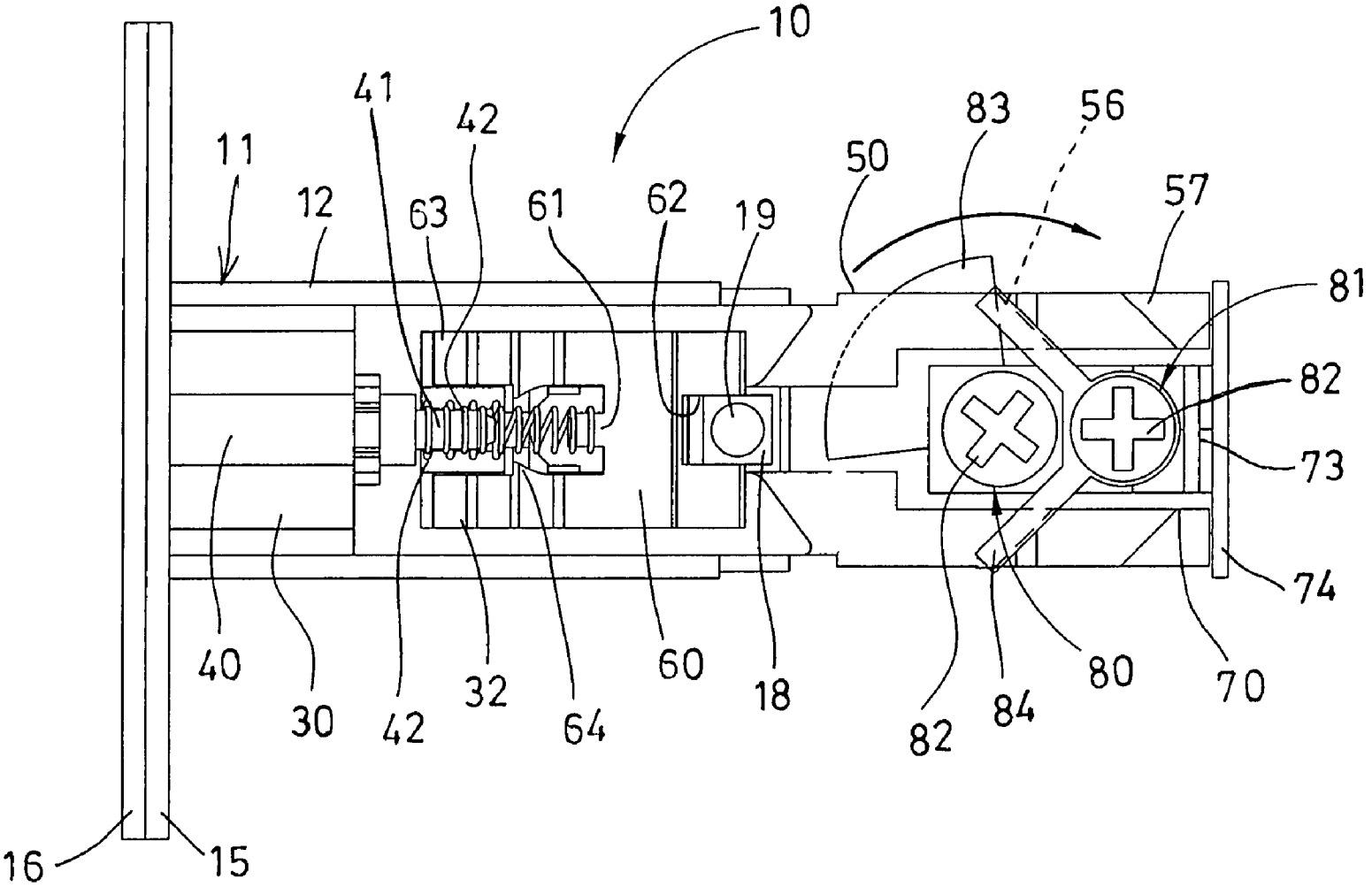
Figure 7:
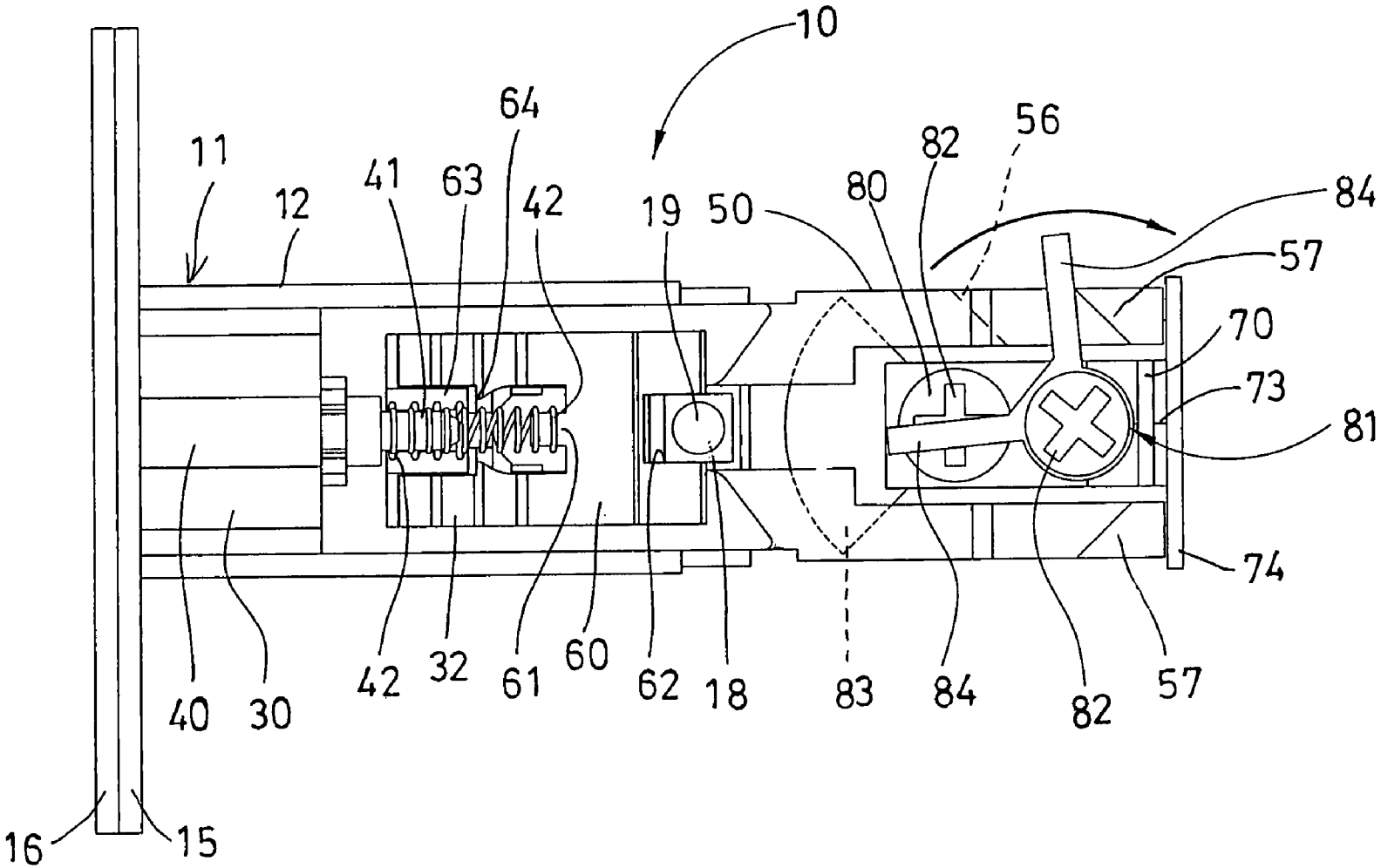

The housing 11 of the tubular door lock 10 includes a chamber 14 formed therein, and an opening 17 formed in the plates 15, 16 and communicating with the chamber 14 thereof, for slidably receiving the dead bolt 30 and the latch 40, and includes a stud 18 extended in the middle or rear portion thereof, and a pin 19 extended from the stud 18, and includes one or more seats 26 formed in the rear portion thereof, and a channel 27 formed in the bottom thereof (FIG. 4).

The dead bolt 30 includes a plate 32 extended rearwardly therefrom and having a passage 33 formed therein, and having a stop 34 extended therefrom and located on one end of the passage 33 thereof, and a peg 35 extended rearwardly therefrom and located below the plate 32, for engaging with one end of a spring 36 which is received in the channel 27 of the housing 11.

The latch 40 also includes a peg 41 extended rearwardly therefrom for engaging with one end of another spring 42, and includes a board 43 extended rearwardly therefrom and located below the peg 41, and slidably engaged onto the plate 32 of the dead bolt 30, and having a passageway 44 formed therein and aligned with the passage 33 of the dead bolt 30 to slidably receive the stop 34 of the dead bolt 30. The board 43 includes one or more protrusions 45 extended therefrom, and extended away from the plate 32.

A follower 50 is slidably received in the chamber 14 of the housing 11, and slidably received between the plate 32 and the peg 35 of the dead bolt 30, and includes a groove 51 formed therein, and defined between two levers 52, for slidably receiving the stud 18 of the housing 11, and thus to guide the follower 50 to move longitudinally relative to the housing 11. The follower 50 may further include one or more shoulders 53 formed therein, to engage with the seats 26 of the housing 11, and to further limit the movement between the follower 50 and the housing 11.

The follower 50 may includes a hook 54 extended from the front portion thereof (FIG. 4), and slidably engaged through the passage 33 of the plate 32, and the passageway 44 of the board 43, and contactable or engageable with the stop 34 of the plate 32, for moving the plate 32 and the dead bolt 30 relative to the housing 11 when the follower 50 is moved relative to the housing 11.

A blade 60 includes an extension 61 extended therefrom for engaging into the other end of the spring 42, and includes a cavity 62 formed therein for receiving the stud 18 of the housing 11, and includes a slot 63 formed therein and opposite to the cavity 62 thereof, to slidably receive the stop 34 of the plate 32, and includes one or more bent projections 64 extended downwardly therefrom for engaging with the protrusions 45 of the board 43.

The protrusions 45 of the board 43 may be engaged or moved beyond the projections 64 of the blade 60 when the latch 40 is moved relative to the housing 11, and the projections 64 of the blade 60 may be engaged with the protrusions 45 of the board 43 relatively, in order to retain the latch 40 in either the inward or the outward position relative to the housing 11. The above-described structure is also typical and will not be described in further details.

Figure 2:
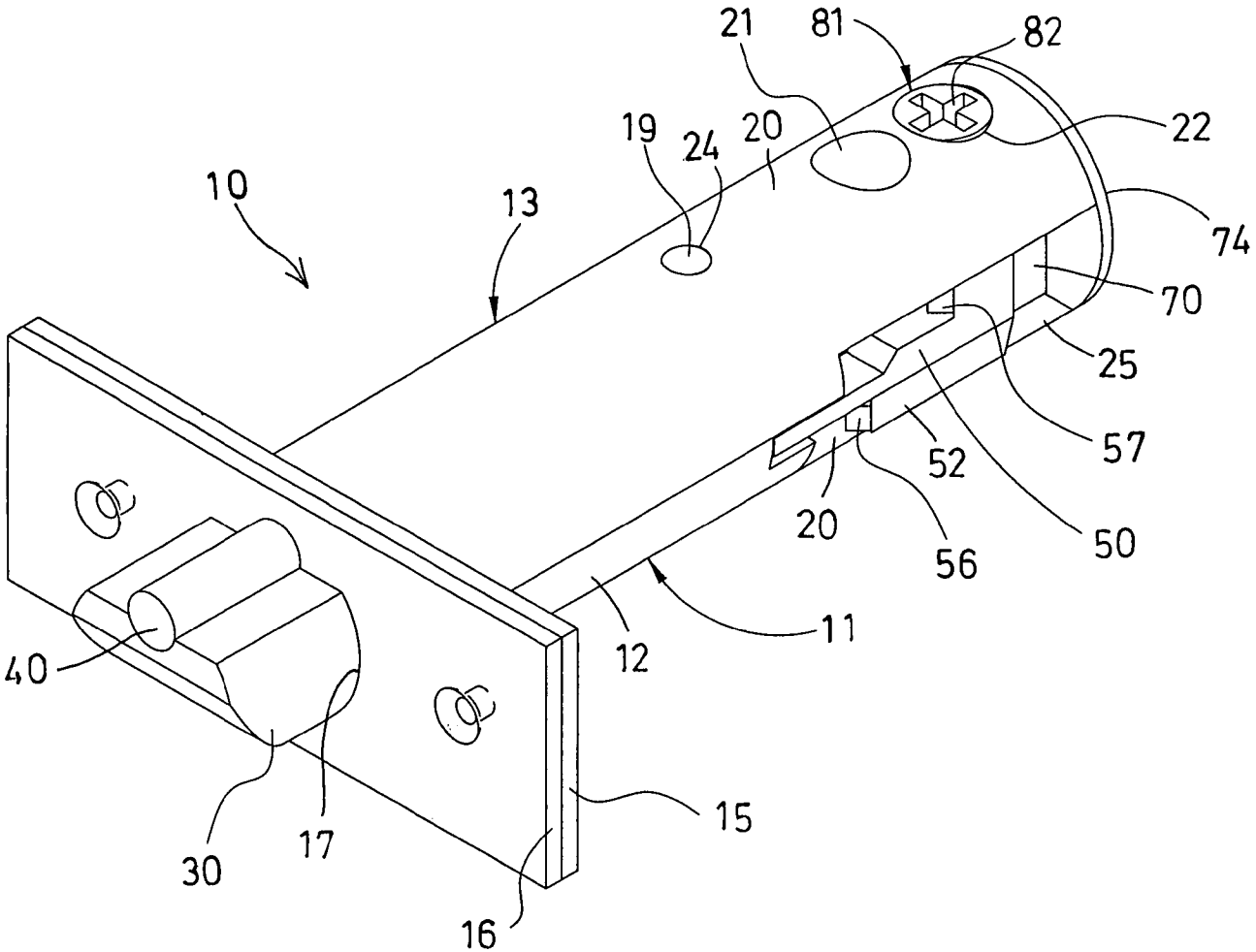
FIG. 2 is a perspective view of the tubular door lock.
Figure 3:
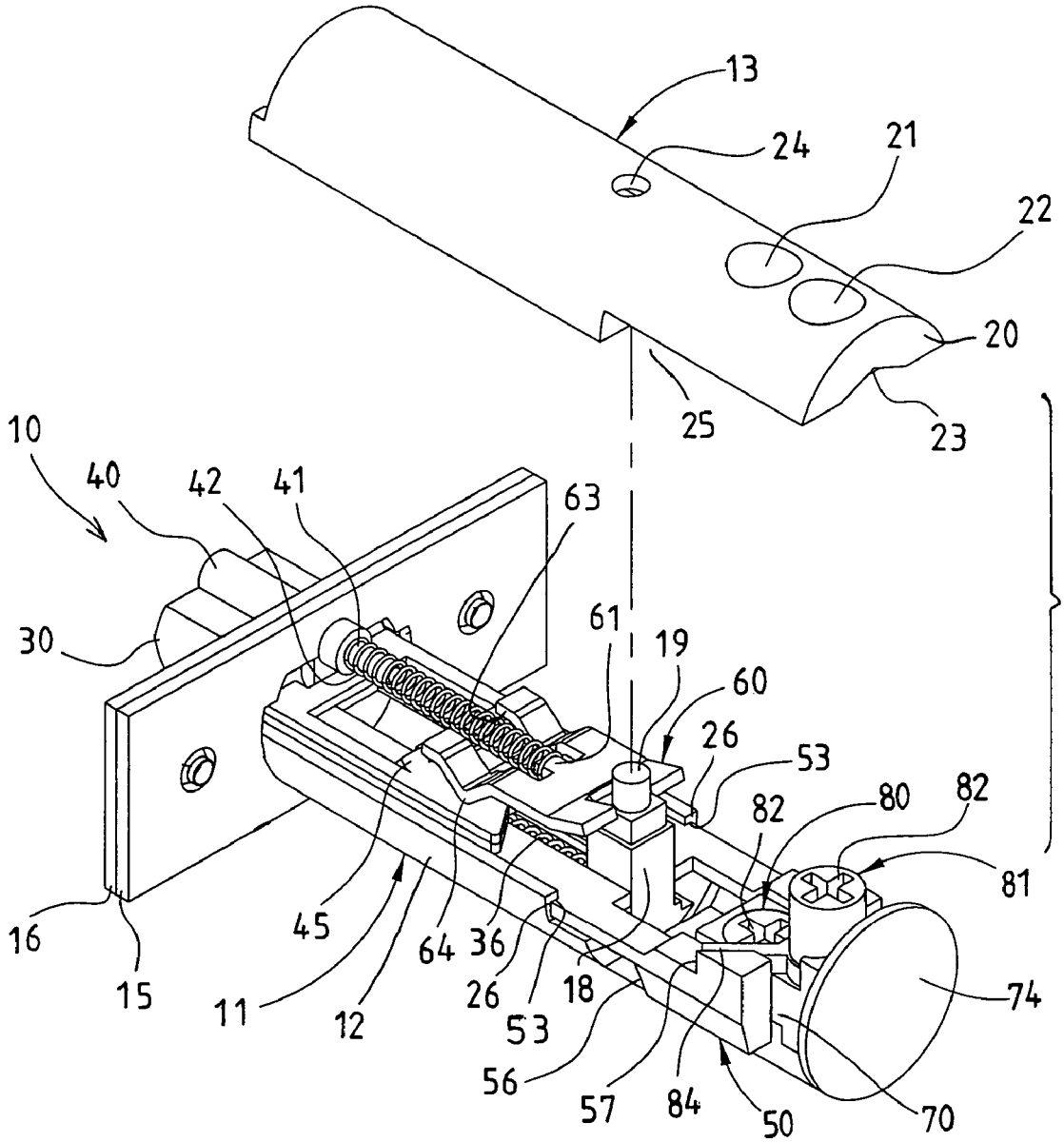
FIG. 3 is a partial exploded view of the tubular door lock.

The tubular door lock 10 in accordance with the present invention further includes two arms 20 extended rearwardly from the housing 11. Each of the arms 20 includes an orifice 21, an aperture 22, and a depression 23 formed therein and aligned with each other. The housing member 13 of the housing 11 includes a hole 24 formed therein to receive the pin 19 and to anchor or secure the housing members 12, 13 together. The arms 20 are spaced away from each other to form or define a space 25 therebetween (FIGS. 2, 3).

The follower 50 further includes an enlarged opening 55 formed therein and communicating with the groove 51 thereof. Each of the levers 52 of the follower 50 includes a seat 56 formed or provided on the lower portion thereof, and another seat 57 formed or provided on the upper portion thereof.

A block 70 is engaged into the space 25 formed or defined between the arms 20, and includes an orifice 71 and an aperture 72 formed therein and aligned with the orifices 21 and the apertures 22 of the arms 20 respectively, and includes one or more, such as two bulges 73 extended therefrom for engaging into the depressions 23 of the arms 20, and for anchoring or positioning the block 70 to the housing 11. The block 70 includes a cap 74 provided on the free end thereof for engaging with the levers 52 of the follower 50, and for further anchoring or positioning the block 70 to the housing 11.

Two actuators 80, 81 are rotatably received in the orifices 21, 71 of the arms 20 and the block 70, and in the apertures 22, 72 of the arms 20 and the block 70 respectively, and each includes two ends each having an engaging hole 82 formed therein for engaging with the typical lock device 91 and the knob 92, and thus for allowing the actuators 80, 81 to be selectively rotated or actuated by the lock device 91 and the knob 92. The typical lock devices 91 and the knobs 92 normally include a stem or a rotating tool (not shown) for engaging into the engaging holes 82 of the actuators 80, 81, and for rotating the actuators 80, 81 relative to the arms 20 and the housing 11.

The actuator 80 includes one or more actuating finger 83 extended therefrom, and located or disposed below the block 70, for engaging with the seats 56 of the levers 52 of the follower 50, and for selectively moving the levers 52 of the follower 50 to pull the dead bolt 30 and/or the latch 40 into the housing 11, when the actuator 80 is rotated relative to the housing 11 by either the lock device 91 or the knob 92.

Similarly, the other actuator 81 also includes one or more actuating finger 84 extended therefrom, and located or disposed above the block 70, for engaging with the other seats 57 of the levers 52 of the follower 50, and for selectively moving the levers 52 of the follower 50 to pull the dead bolt 30 and/or the latch 40 into the housing 11, when the actuator 81 is rotated relative to the housing 11 by either the lock device 91 or the knob 92.

It is to be noted that the actuators 80, 81 are disposed in the arms 20 and the block 70, and are spaced away from each other, for allowing either of the actuators 80, 81 to fit the lock device 91 or the knob 92 at different location relative to the door panel 90. The lock device 91 or the knob 92 may be limited to be disposed in some of the selected positions, but may not be disposed in the other positions relative to the door panel 90, for example.

The provision and the engagement of the actuators 80, 81 in different positions relative to the arms 20 and the block 70 allows the lock device 91 or the knob 92 to engage with and to be secured to either of actuators 80, 81, and thus for allowing the tubular door lock 10 in accordance with the present invention to be easily secured into the door panel 90 and to be easily coupled to the lock device 91 and the knob 92.

Accordingly, the tubular door lock in accordance with the present invention includes selective actuators for fitting to different door panels.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A tubular door lock comprising:

a housing including a chamber and an opening formed therein and communicating with each other, and including two arms extended therefrom and each having an orifice and an aperture and a depression formed therein, said arms being spaced away from each other to form a space therebetween, a dead bolt slidably received in said chamber and said opening of said housing, and movable in and out of said opening of said housing, said dead bolt including a plate extended therefrom and having a passage formed therein, a follower slidably received in said chamber of said housing, and coupled to said dead bolt, for moving said dead bolt relative to said chamber and said opening of said housing, said follower including a groove formed therein, and defined between two levers, each of said levers of said follower including a lower portion having a first seat provided thereon said thereof, and an upper portion having a second seat provided thereon, said follower including at least one shoulder formed therein, to engage with said housing, and to limit a movement between said follower and said housing, said housing including a stud extended therein and engaged into said groove of said follower, to guide said follower to move relative to said housing, a block engaged into said space formed between said arms, and including an orifice and an aperture formed therein and aligned with said orifices and the apertures of said arms respectively, and including at least one bulge extended therefrom for engaging into said depressions of said arms, and for anchoring said block to said housing, two actuators rotatably received in said orifices and said apertures of said arms of said housing respectively, and also rotatably received in said orifice and said aperture of said block respectively, and each actuator including at least one actuating finger selectively engageable with said first and said second seats of said levers of said follower, for selectively actuating said levers of said follower to move said dead bolt relative to said housing, when said actuators are rotated relative to said housing, and said follower including a hook extended therefrom, and slidably engaged through said passage of said plate, and engageable with said plate, for moving said plate and said dead bolt relative to said housing when said follower is moved relative to said housing by either of said actuators.

2. The tubular door lock as claimed in claim 1, wherein each of said actuators includes an engaging hole formed therein for receiving rotating tools.

3. The tubular door lock as claimed in claim 1, wherein said block includes a cap provided thereon for engaging with said levers of said follower, and for anchoring said block to said housing.

* * * * *